US008299344B2

(12) United States Patent
Osuga et al.

(10) Patent No.: US 8,299,344 B2
(45) Date of Patent: Oct. 30, 2012

(54) KEY AND KEYBOARD APPARATUS

(75) Inventors: Ichiro Osuga, Hamamatsu (JP); Hiroyasu Abe, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 12/987,965

(22) Filed: Jan. 10, 2011

(65) Prior Publication Data

US 2011/0100196 A1 May 5, 2011

Related U.S. Application Data

(62) Division of application No. 12/369,623, filed on Feb. 11, 2009, now Pat. No. 7,952,011.

(30) Foreign Application Priority Data

Feb. 18, 2008 (JP) ..... 2008-036185

(51) Int. Cl.
*G10C 3/12* (2006.01)

(52) U.S. Cl. ..... 84/433; 84/438

(58) Field of Classification Search ..... 84/433, 84/423 R, 438

See application file for complete search history.

(56) References Cited

U.S. PATENT DOCUMENTS

| | | | |
|---|---|---|---|
| 7,952,011 | B2 | 5/2011 | Osuga et al. |
| 2009/0205478 | A1 | 8/2009 | Osuga et al. |

FOREIGN PATENT DOCUMENTS

| | | | | |
|---|---|---|---|---|
| JP | 2000-176910 | A | | 6/2000 |
| JP | 2006-289847 | A | | 10/2006 |
| JP | 2006289847 | A | * | 10/2006 |

* cited by examiner

*Primary Examiner* — Jianchun Qin
(74) *Attorney, Agent, or Firm* — Morrison & Foerster LLP

(57) ABSTRACT

A key having a key-depression surface with a woody characteristic and durability without the need of a surface treatment and capable of being formed from a simple-shaped uncompressed wood. A key for use as a black key includes a resin part and a compressed wood part secured at its lower surface to an upper surface of the resin part. The compressed wood part is used to constitute a portion of a key top including an upper surface and positioned above an upper surface of white keys which are in a non-key-depression state. The compressed wood part is obtained by compression molding of unprocessed wood. The compressed density in the vertical direction in the compressed wood part is higher toward rearward from a front end of the compressed wood part.

15 Claims, 13 Drawing Sheets

KEY AND KEYBOARD APPARATUS

CROSS-REFERENCE TO RELATED APPLICATIONS

This application is a divisional of U.S. patent application Ser. No. 12/369,623, now U.S. Pat. No. 7,952,011, filed Feb. 11, 2009, which claims priority to Japanese Application No. 2008-036185, filed Feb. 18, 2008, the entire disclosures of which are incorporated herein by reference.

BACKGROUND OF THE INVENTION

1. Field of the Invention

The present invention relates to a key and a keyboard apparatus for use in a keyboard instrument.

2. Description of the Related Art

A keyboard instrument having keys made of wood are conventionally known. Also known is a key including a key top part having a key depression surface and made of wood to provide a quality appearance, and including a part made of resin and disposed beneath the key top part.

Since keys made of wood are not high in hardness and durability at the upper surfaces or key-depression surfaces, a surface treatment such as painting is applied to the upper surfaces. As a result, a woody characteristic of the keys is impaired.

Also known is a keyboard instrument having black keys made of compressed wood (paragraph 0014 of Japanese Laid-open Patent Publication No. 2000-176910).

Japanese Laid-open Patent Publication No. 2000-176910 does not disclose detailed study on the shape of compression moldings (black keys), a relation of the shape of compression moldings and the shape of uncompressed wood, the compressed density, etc. Thus, further study is demanded.

SUMMARY OF THE INVENTION

The present invention provides a key having a key-depression surface with a woody characteristic and durability without the need of a surface treatment and capable of being formed from a simple-shaped uncompressed wood, and provides a keyboard apparatus including keys of this type.

According to a first aspect of this invention, there is provided a key for use as a black key of a keyboard instrument comprising a first part including an upper surface that constitutes at least a key-depression surface of the key, wherein the first part is made of compressed wood, the first part made of compressed wood includes at least a second part adapted to be positioned above upper surfaces of white keys of the keyboard instrument which are in a non-key depression state, and a compressed density in a vertical direction in the second part is higher toward rearward from a front end of the second part.

According to a second aspect of this invention, there is provided a key for use as a black key of a keyboard instrument comprising a first part including an upper surface that constitutes at least a key-depression surface of the key, wherein the first part is made of compressed wood, the first part made of compressed wood includes at least a second part adapted to be positioned above upper surfaces of white keys of the keyboard instrument which are in a non-key depression state, and a compressed density in a width direction in the second part of the key is lower toward downward from the upper surface of the first part of the key.

According to a third aspect of this invention, there is provided a key for a keyboard instrument comprising a part including an upper surface that constitutes at least a key-depression surface of the key, wherein the part of the key is made of compressed wood, and the part made of compressed wood includes portions that constitute corner portions and ridge portions of the key and are higher in compressed density than in other portions of the part made of compressed wood.

According to the first, second, and third aspects of this invention, a key having a key-depression surface with a woody characteristic and durability without the need of a surface treatment can be formed from a simple-shaped uncompressed wood.

Burrs produced on the first part at compression molding can protrude only downward from front, rear, left, and right surfaces of the first part of the key.

In that case, a burr removal process is unnecessary, and the safety at musical performance and a satisfactory external appearance can be ensured.

A woodgrain direction of the first part made of compressed wood can extend in a longitudinal direction of the key.

In that case, compression molding can easily be carried out, and a woodgrain pattern provided by compression can be made natural, whereby the external appearance can be improved.

A compressed density of the first part made of compressed wood can be higher in the vertical direction than in a width direction.

In that case, intervals in a woodgrain pattern on the key-depression surface liable to catch the eye are not made too narrow, whereby a natural woody texture can be provided and the external appearance can be improved.

The corner portions and the ridge portions of the key can have a color tone darker than that of the other portions of the key by having a compressed density higher than that of other portions of the key.

In that case, the contour of the key can be made clearly visible, even if special coloring or other treatment is not applied to the corner portions and the ridge portions.

According to a fourth aspect of this invention, there is provided a keyboard apparatus including a plurality of keys, wherein at least part of the plurality of keys are each formed by the key according to the first aspect of this invention.

According to a fifth aspect of this invention, there is provided a keyboard apparatus including a plurality of keys, wherein at least part of the plurality of keys are each formed by the key according to the second aspect of this invention.

According to a sixth aspect of this invention, there is provided a keyboard apparatus including a plurality of keys, wherein at least part of the plurality of keys are each formed by the key according to the third embodiment of this invention.

According to the fourth, fifth, and sixth aspects of this invention, a key having a key-depression surface with a woody characteristic and durability without the need of a surface treatment can be formed from a simple-shaped uncompressed wood.

The plurality of keys can include a plurality of white keys and a plurality of black keys, each of the white keys and the black keys can have the first part including the upper surface of the key and made of compressed wood, and the compressed density in the vertical direction in the first parts of the black keys can be higher than the compressed density in the vertical direction in the first parts of the white keys. A color tone of at least upper surfaces of the first parts of the black keys can be made darker than a color tone of the first parts of the white keys by making the compressed density in the vertical direction in the first parts of the black keys higher than the compressed density in the vertical direction in the first parts of the white keys.

In that case, the white key and the black key can easily be visually distinguished from one another, without the need of applying thereto surface painting in white and black in color.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1:
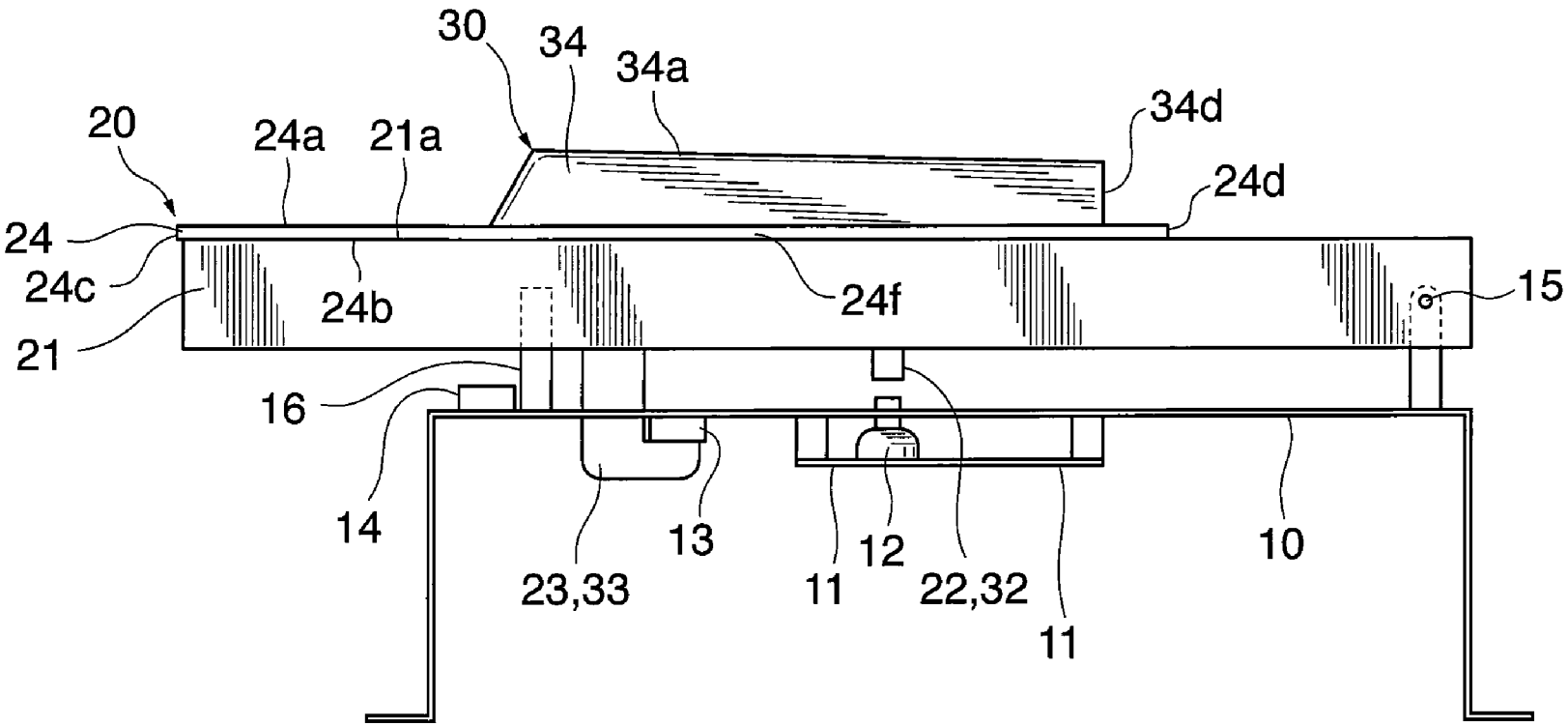
FIG. 1 is a schematic longitudinal section view showing a keyboard apparatus of an electronic keyboard instrument, to which keys according to one embodiment of this invention are applied.

FIG. 1 schematically shows in longitudinal section view a keyboard apparatus of an electronic keyboard instrument to which are applied keys according to one embodiment of this invention. In FIG. 1, the keyboard apparatus is shown in a non-key-depression state. In the following, the side of the keyboard apparatus toward a player (the left side in FIG. 1) will be referred to as the front side, and the left-to-right direction will be defined with reference to the player.

The keyboard apparatus includes a frame 10 on which a plurality of white keys and a plurality of black keys 30 are disposed in parallel to one another. The white and black keys 20, 30 have front lower portions thereof formed with pendent engagement parts 23, 33 extending downward and formed into an L-shape as seen from side. Actuators 22, 32 are provided in the keys at portions rearward of the pendent engagement parts 23, 33.

The white and black keys 20, 30 have their upper surfaces 24*a*, 34*a*, which are key-depression surfaces. The keys 20, 30 are each adapted to be pivoted relative to the frame around a key fulcrum disposed on the rear side of the key. When a key depressing/releasing operation is performed on the upper surface of one of the keys, a tip end of the depressed/released key moves in a vertical direction. The keys 20, 30 are always urged by springs or other urging means such that the tip ends are moved upward. The white keys are the same in construction as one another, and the black keys are the same in construction as one another.

There are provided in a front half of the frame 10 a depressed key stopper 14 and a released key stopper 13 each of which is formed by an elastic member such as felt. In a non-key-depression state, the pendent engagement parts 23, 33 of the white and black keys 20, 30 are in contact with the released key stopper 13, thereby defining initial positions of the keys 20, 30 in the forward stroke of the pivotal motion. In a key-depression completion state, lower surfaces of the keys 20, 30 are in contact with the depressed key stopper 14, thereby defining end positions of the keys 20, 30 in the forward stroke of the pivotal motion.

Key operation guides 16 for the keys 20, 30 are provided on the frame at locations rearward of the depressed key stopper 14. On a base plate 11 in the frame 10, key switches 12 are provided to correspond to respective ones of the keys 20, 30. Each key switch 12, when depressed by a corresponding key 20 or 30, detects a key operation such as key velocity. In accordance with a result of the detection, musical tone control is carried out by a musical tone controller, not shown.

Figure 2A:
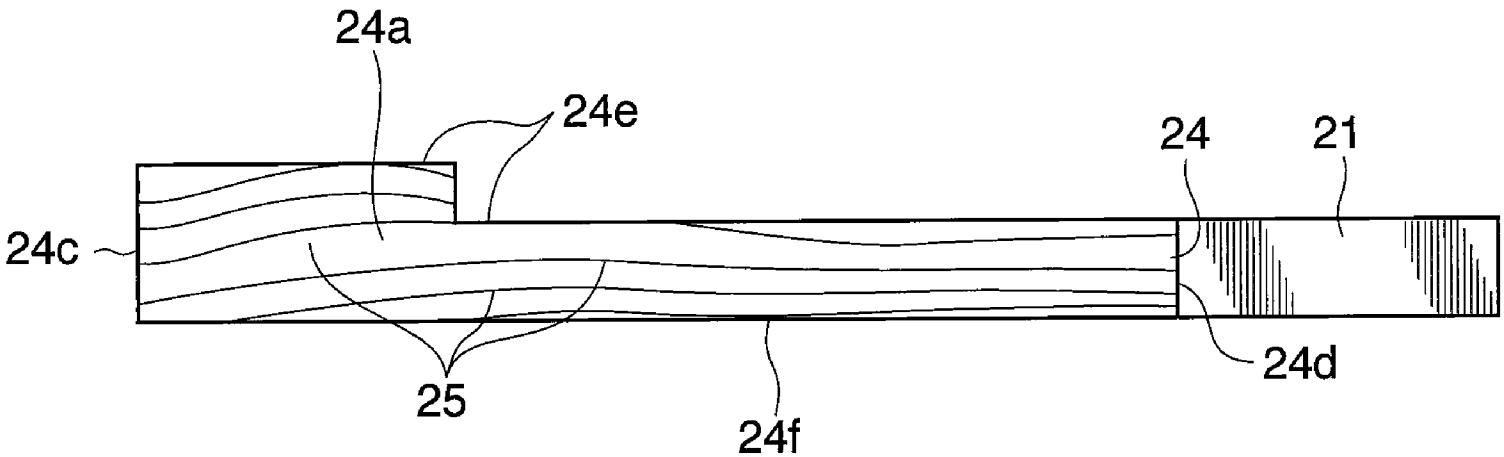
FIG. 2A is a plan view showing a white key.
Figure 2B:
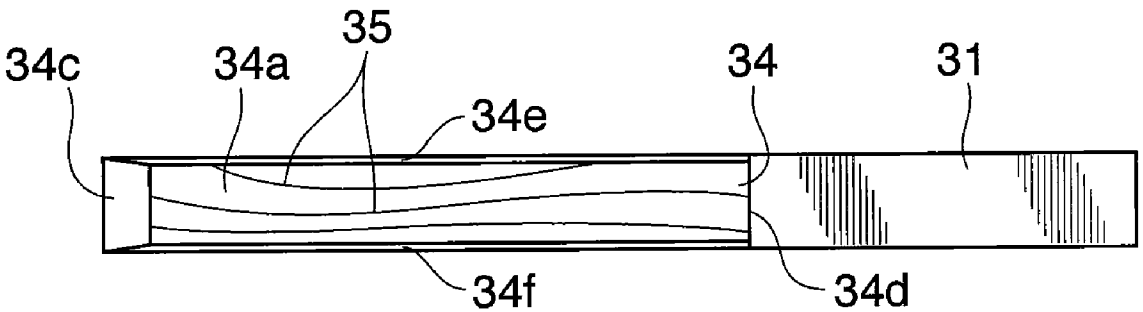
FIGS. 2B, 2C, and 2D are a plane view, a front view, and a right side view of a black key.
Figure 2D:
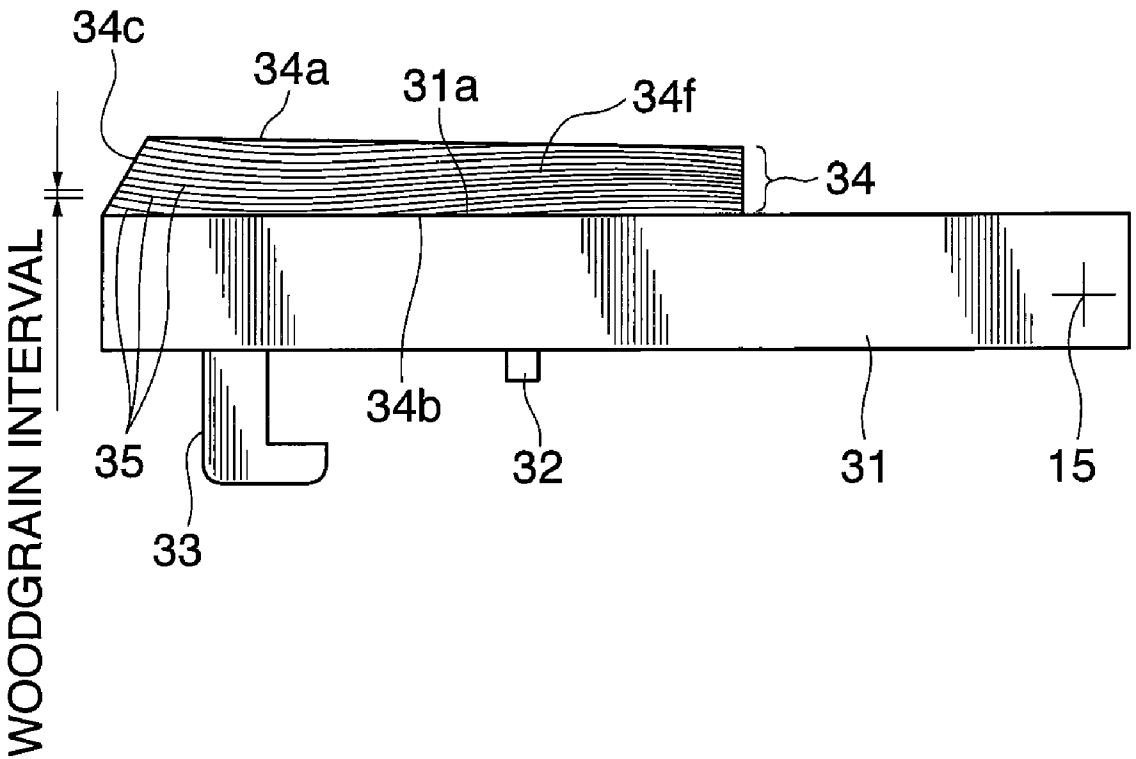
Figure 2C:
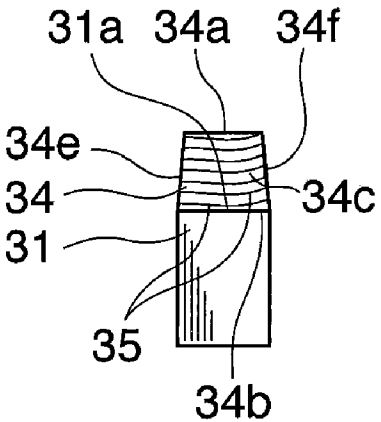

FIG. 2A shows one of the white keys in plan view. FIG. 2B to 2D show one of the black keys 30 in plane view, front view, and right side view. In these figures, the contour shapes of the keys are schematically shown.

The white key is comprised of a resin part 21 and a compressed wood part 24. The resin part 21 is affixed or secured at its upper surface 21*a* to a lower surface 24*b* of the compressed wood part 24 by adhesive or the like (see FIG. 1). The black key is comprised of a resin part 31 and a compressed wood part 34. The resin part 31 is affixed or secured at its upper surface 31*a* to a lower surface 34*b* of the compressed wood part 34 by adhesive or the like (see FIGS. 2C and 2D).

In the example of this embodiment, the compressed wood parts 24, 34 are applied to so-called key top portions of the white and black keys 20, 30. In the white key 20, the compressed wood part 24, which is formed into a plate shape, is only applied to a surface layer of the white key 20. In the black key 30, the compressed wood part 34 is applied to the entirety of that part of the black key which is disposed above the upper surface 24*a* of the white key which is in a non-key-depression state. As described above and as will be described with reference to a modification of this embodiment (FIG. 9), the compressed wood parts 24, 34 are applied to at least those parts of the white and black keys which include the upper surfaces 24*a*, 34*a* that constitute the key-depression surfaces.

The compressed wood parts 24, 34 are made of wood compressed in dense by compression molding. A molding process therefor will be described later (FIGS. 4 to 6). Woodgrain patterns 25, 35 appear on upper surfaces 24*a*, 34*a*, front surfaces 24*c*, 34*c*, rear surfaces 24*d*, 34*d*, left side surfaces 24*e*, 34*e*, and right side surfaces 24*f*, 34*f* of the compressed wood parts 24, 34, whereby a high-quality woody appearance is provided. In FIGS. 2A to 2D, the woodgrain patterns 25, 35 appearing on the surfaces of the compressed wood parts are partly shown.

Pieces of wood before subjected to a compression process (hereinafter referred to as the "unprocessed or unfinished wood BS" (see FIGS. 4 to 6)) are prepared such that woodgrain directions thereof extend along the longitudinal directions of the white and black keys 20, 30. As a result, the fibrous woodgrain patterns 25, 35 of the compressed wood parts 24, 34 obtained by the compression process also extend along the longitudinal directions of the white and black keys 20, (see FIGS. 2A, 2B and 2D).

Pieces of unprocessed wood BS are compressed to be formed into the compressed wood parts 24, 34 in which the compressed density (or compression rate) in the vertical direction is higher than the highest density (at upper end) in the width direction. In the black key 30, therefore, intervals in the woodgrain pattern 35 are broad on the upper surface 34*a* of the compressed wood part 34 (see FIG. 2B), and are narrower on the front surface 34*c*, the left side surface 34*e*, and the right side surface 34*f* of the compressed wood part 34 than on the upper surface 34*a* (see FIGS. 2C, 2D in which the woodgrain pattern on the left side surface 34*e* is not shown). The above tendency is also found in the woodgrain pattern in the white key 20.

In the black key 30, as shown in FIG. 2D, the lower surface 34*b* of the compressed wood part 34 extends horizontally. On the other hand, the height of the upper surface 34*a* is made lower toward rearward, and therefore, the compressed density in the vertical direction is higher toward rearward from the front end of the compressed wood part 34. Thus, intervals in the woodgrain pattern appearing on the left and right side surfaces 34*e*, 34*f* are narrower toward rearward. As shown in FIG. 2C, the compressed wood part 34 is formed into a trapezoidal shape as seen from front, and therefore, the compressed density in the width direction is lower toward downward from the upper surface 34*a*.

Figure 3A:
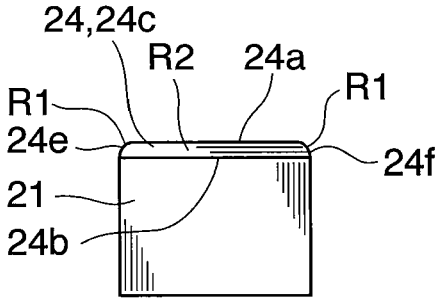
FIG. 3A is a front view of the white key.
Figure 3B:
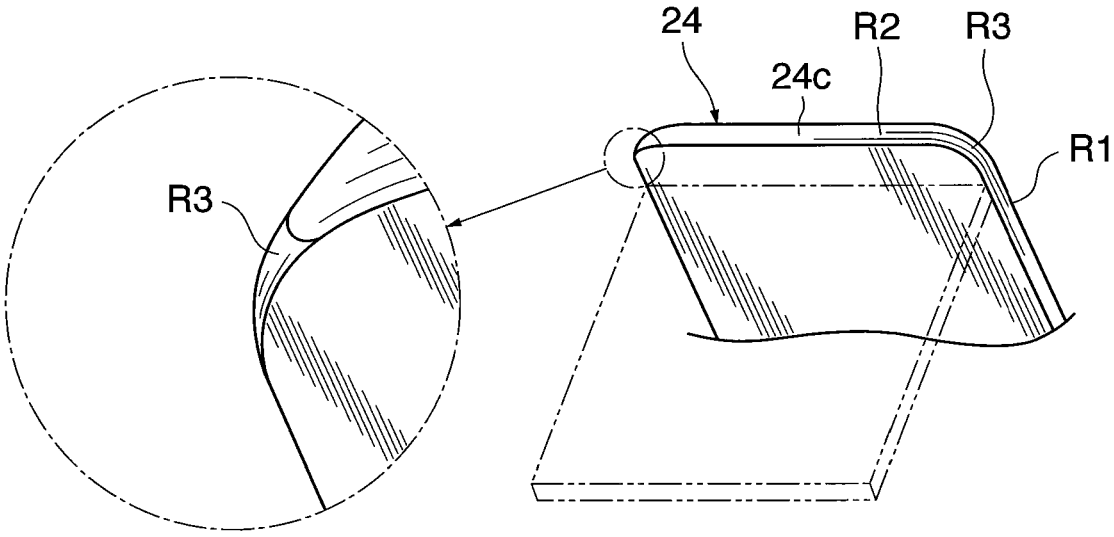
FIG. 3B is a perspective view and a fragmentary enlarged view showing a front end portion of a compressed wood part of the white key.
Figure 3C:
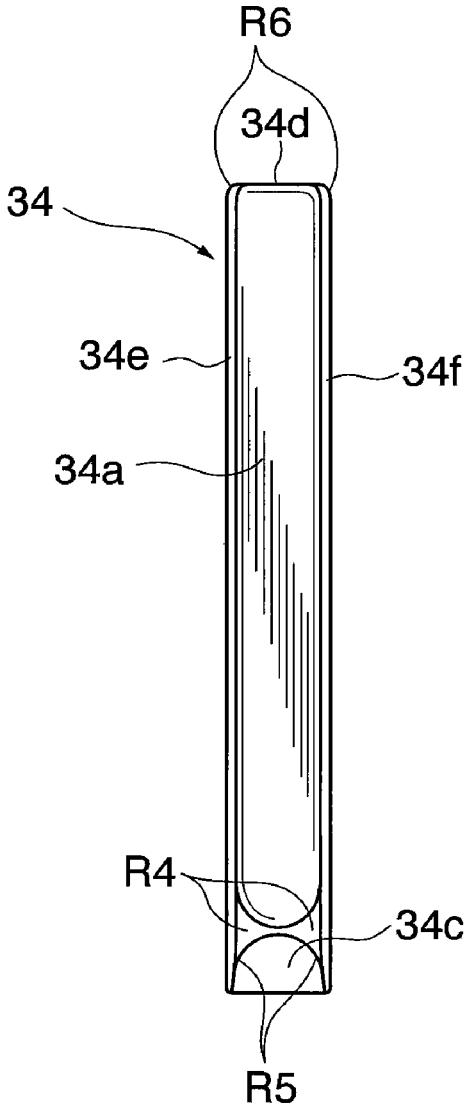
FIGS. 3C and 3D are a plan view and a front view showing a compressed wood part of the black key.
Figure 3D:
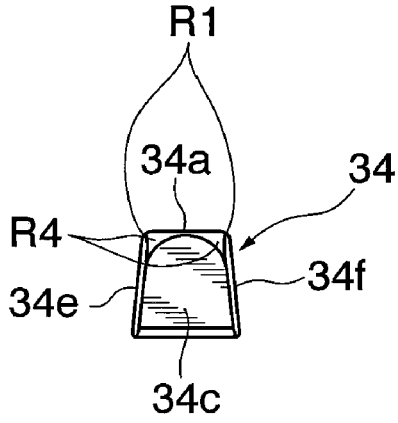

FIG. 3A shows one of the white keys in front view, and FIG. 3B shows a front end portion of the compressed wood part 24 of the white key in perspective view and in fragmentary enlarged view. FIG. 3C shows the compressed wood part 34 of one of the black keys in plan view, and FIG. 3D shows the compressed wood part 34 in front view. In these drawings, there are mainly shown the contour shapes of the compressed wood parts 24, 34, with illustrations of the woodgrain patterns 25, 35 appearing thereon omitted.

The compressed wood parts 24, 34 have portions that constitute edge portions (corner portions and ridge portions) of the white and black keys 20, 30. These portions of the compressed wood parts 24, 34 are higher in compressed density than the other portions thereof, and are each formed into a rounded shape. For example, in the compressed wood part 24 of the white key 20, ridge portions R1 are formed by the upper surface 24*a* and the left and right side surfaces 24*e*, 24*f* (see FIG. 3A), and a longitudinal ridge portion R2 is formed by the upper surface 24*a* and the front surface 24*c* (see FIG. 3B). The ridge portions R1, R2 are rounded into round-shaped ridges. Corner portions R3 formed at upper left and upper right of the front end of the compressed wood part 24 by the upper surface 24*a*, 35 the front surface 24*c*, and the left and right side surfaces 24*e*, 24*f* (see FIG. 3B) are also rounded into a round shape.

In the compressed wood part 34 of the black key 30, longitudinal ridge portions R1 are formed into round-shaped ridges by the upper surface 34*a* and the left and right side surfaces 34*e*, 34*f* (see FIG. 3D). As shown in FIG. 3C, corner portions R4 formed at upper portions of the front end of the compressed wood part 34 by the upper surface 34*a*, the front surface 34*c*, and the left and right side surfaces 34*e*, 34*f* are also formed into a rounded shape. Obliquely longitudinal ridge portions R5 formed continuous to the corner portions R4 by the front surface 34*c* and the left and right side surfaces 34*e*, 34*f* are also formed into a rounded shape. Also, longitudinal ridge portions R6 are formed into a rounded shape by the rear surface 34*d* and the left and right side surfaces 34*e*, 34*f*.

Besides, those portions (not shown) of the compressed wood parts 24, 34 which constitute corner and ridge portions and are not continuous to the lower surfaces 24*b*, 34*b* are formed into a rounded shape and higher in compressed density than other portions. It should be noted that it is not essentially required to form the corner and ridge portions into a rounded shape so long as they can be made higher in density by compression.

Next, a process for compression-molding unprocessed or unfinished wood BS into the compressed wood part 34 of the black key is described. The compression molding process mainly includes four processes, i.e., a vertical compression process, a transverse compression process, a round-shape formation process, and a removal process.

FIGS. 4A, 4B, 5A to 5C, and 6A to 6D schematically show the vertical compression process, the transverse compression process, the round-shape formation process, and the removal process. Unprocessed or unfinished wood BS as seen from front is shown in the left drawings in FIGS. 4A and 4B, and unprocessed or unfinished wood BS as seen from side is shown on the right drawings in FIGS. 4A and 4B. In FIGS. 5A to 5C and 6A to FIG. 6C, there is shown unfinished wood BS as seen from front.

Although the type of unprocessed wood BS is not limited, wood derived from a broad leaf tree, which is disclosed in Japanese Laid-open Patent Publication No. 2000-176910, may be used as the unprocessed wood BS. In the following, the unprocessed or unfinished wood BS will be indicated by different suffixes according to which stage the unprocessed or unfinished wood BS is in. A suffix BS0 indicates unprocessed wood before being processed in the vertical compression process, a suffix BS1 indicates unfinished wood already processed in the vertical compression process but not processed in the transverse compression process, a suffix BS2 indicates unfinished wood already processed in the transverse compression process but not processed in the round-shape formation process, and a suffix BS3 indicates unfinished wood processed in the round-shape formation process.

Figure 4A:
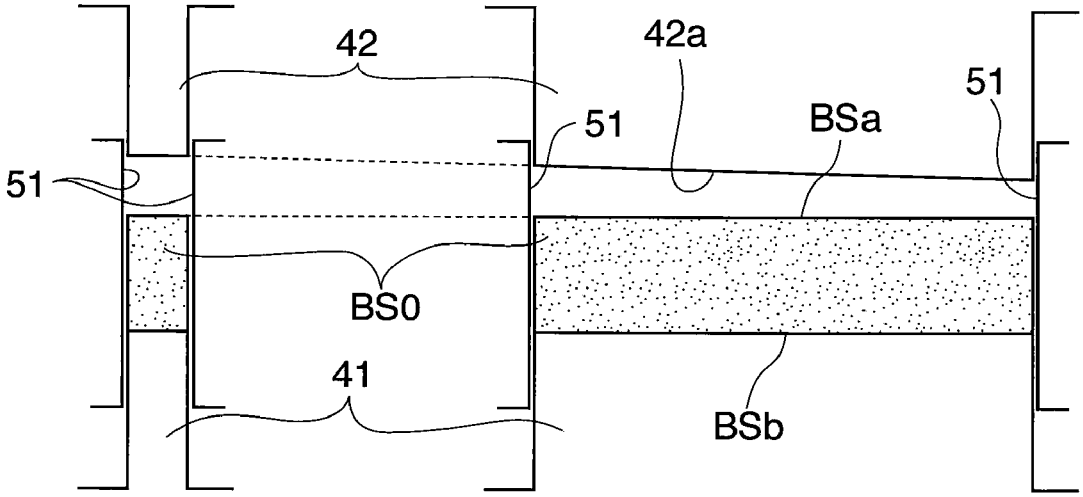
FIGS. 4A and 4B are schematic views showing a vertical compression process in a process for compression-molding unprocessed wood into the compressed wood part of the black key.

In FIG. 4A, there are shown upper- and lower-surface equivalent portions BSa, BSb of the unprocessed wood BS0, which will constitute the upper and lower surfaces 34*a*, 34*b* of the compressed wood part 34. The left end of the unprocessed wood BS0 in the right drawing in FIG. 4A corresponds to the front end of the compressed wood part 34. The unprocessed wood BS0, which is a rectangular parallelepiped, is prepared such that its grain direction extends in the longitudinal direction (the left-to-right direction in the right drawing in FIG. 4A). Thus, the unprocessed wood BS0 is pressed in dense in the direction perpendicular to its fiber direction.

Figure 4B:
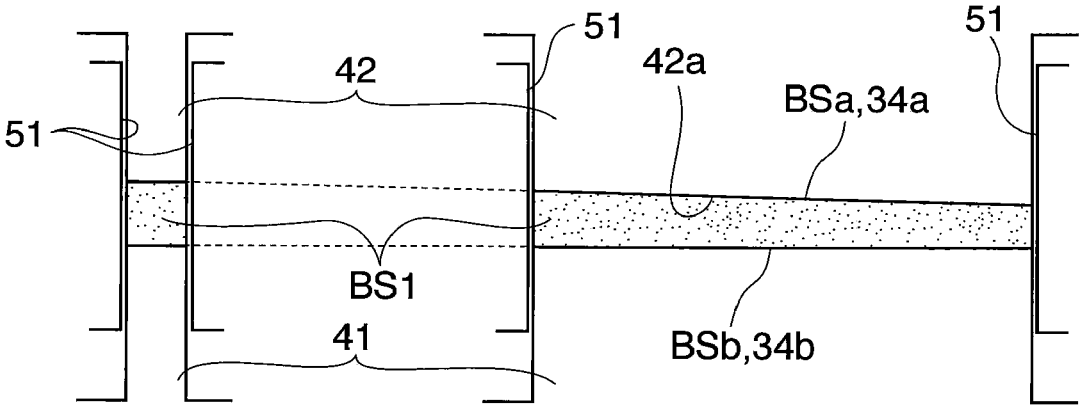

As shown in FIGS. 4A and 4B, in the vertical compression process, the unprocessed wood BS0 is compression-molded by a lower die 41 and an upper die 42, which are guided by guides 51. The lower-surface equivalent portion BSb of the unprocessed wood BS0 may temporarily be fixed by any means to the lower die 41 which is stationary. The unprocessed wood BS0 has a height as large as about several times that of the compressed wood part 34. When the upper die 42 is moved downward to press the unprocessed wood BS0, the unprocessed wood BS0 is compressed in the vertical direction, whereby the unfinished wood BS1 can be obtained (see FIG. 4B).

Figure 5A:
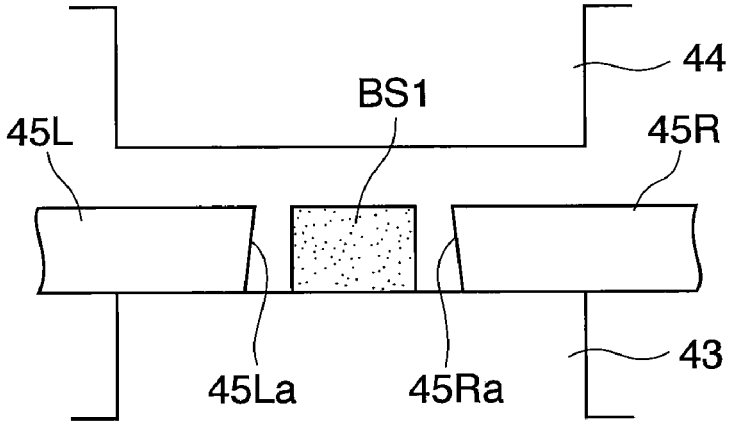
FIGS. 5A, 5B, and 5C are schematic views showing a transverse compression process in the, compression molding process.
Figure 5B:
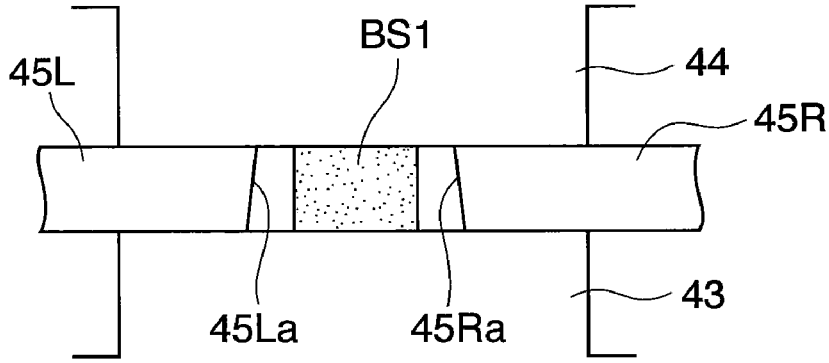
Figure 5C:
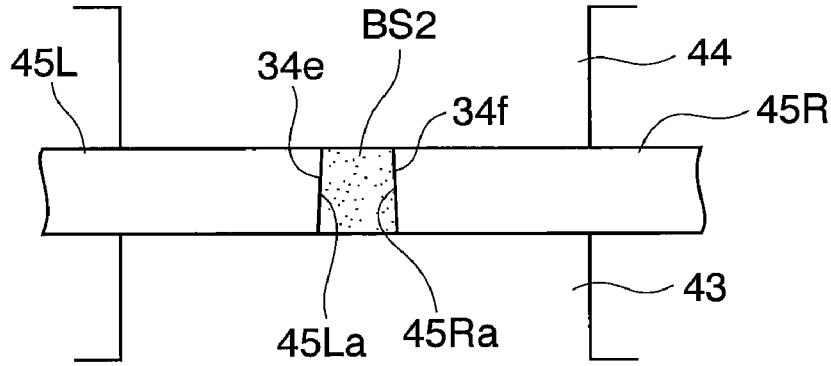

As shown in FIGS. 5A to 5C, in the transverse compression process, the unfinished wood BS1 formed by the vertical compression process is further molded by a lower die 43, an upper die 44, a left die 45L, and a right die 45R. The lower die 43 is stationary, and the other dies are movable. However, either the left die 45L or the right die 45R may be kept stationary.

First, the unfinished wood BS1 is placed on the lower die 43 (FIG. 5A), and the upper die 44 is moved downward toward the unfinished wood BS1 and brought in contact with the upper surface of the unfinished wood BS1 (FIG. 5B). Next, the left and right dies 45L, 45R are moved to sandwich and compress the unfinished wood BS1 from left and right. Thus, the unfinished wood BS1 is compressed in the left-to-right direction (width direction), whereby unfinished wood BS2 can be obtained (see FIG. 5C).

The unfinished wood BS2 has surfaces thereof compressed by an end surface 45La of the left die 45L and an end surface 45Ra of the right die 45R. These surfaces of the unfinished wood BS2 constitute the left and right side surfaces 34*e*, 34*f* of the compressed wood part 34 (see FIG. 2C). The shape of the unprocessed wood BS0 and the shape of the unfinished wood BS1 are defined such that the rate of compression by the lower and upper dies 41, 42 is made higher than that by the left and right dies 45L, 45R.

Figure 6B:
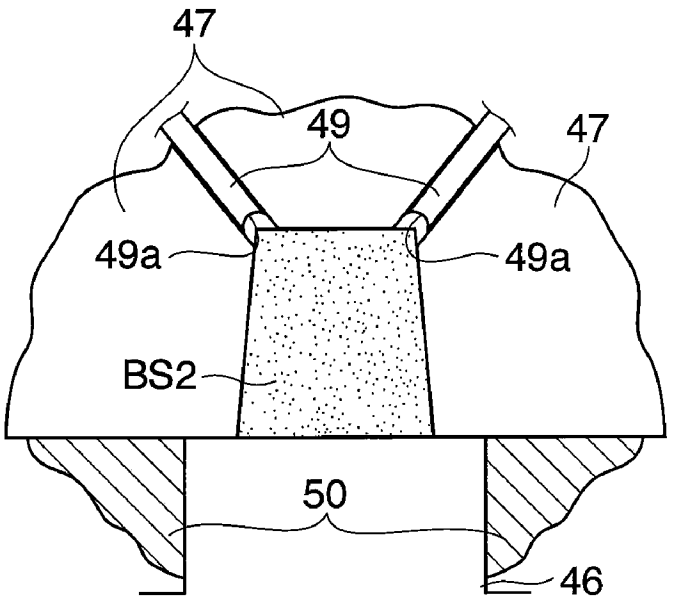
FIGS. 6A, 6B, and 6C are schematic views showing a round-shape formation process in the compression molding process.
Figure 6A:
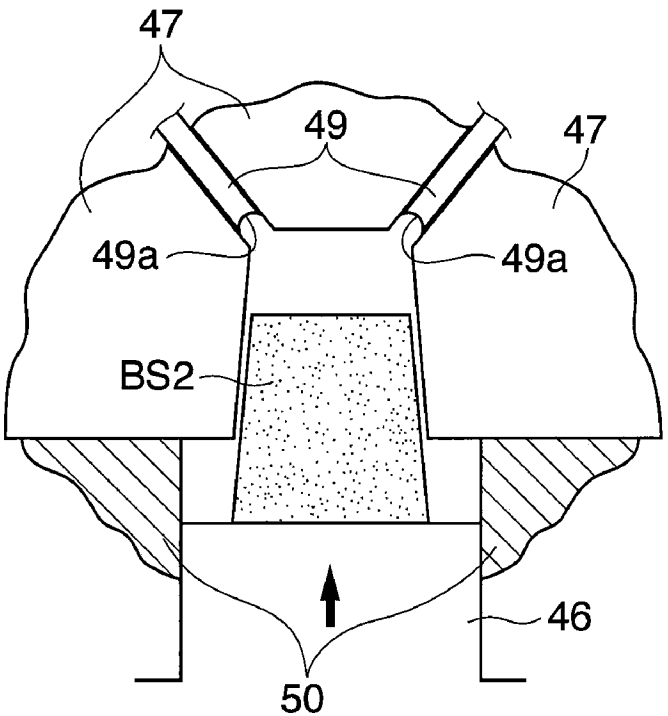
Figure 6D:
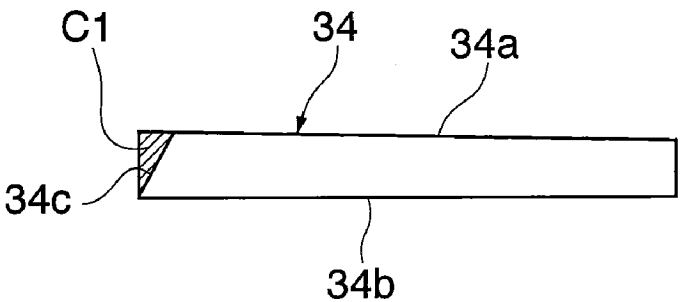
FIG. 6D is a schematic view showing a removal process.
Figure 6C:
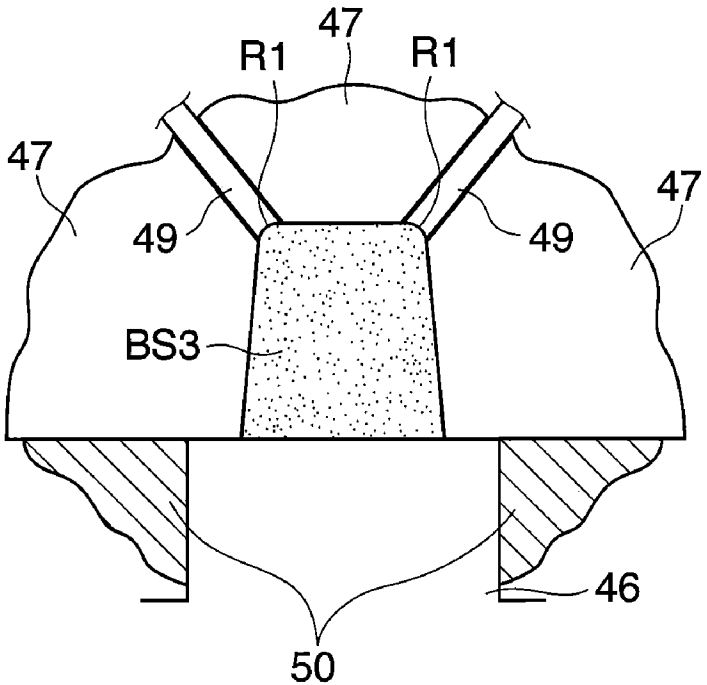

As shown in FIGS. 6A to 6C, in the round-shape formation process, the unfinished wood BS2 formed by the transverse compression process is further molded by a lower die 46, an upper die 47, and two round-shaping dies 49 disposed to be movable in the upper die 47. The upper die 47 is kept stationary, and the lower die 46 is vertically movable while being guided by guides 50. The round-shaping dies 49 have tip ends 49*a* thereof formed into round shapes corresponding to the shapes of the ridge portions R1 (see FIG. 3D).

First, the unfinished wood BS2 is placed on the lower die 46 (FIG. 6A), the lower die 46 is moved upward whereby the unfinished wood BS2 is inserted into a recess defined by the upper die 47, and an upper surface of the unfinished wood BS2 is brought in contact with a ceiling surface of the upper die 47 (FIG. 6B). Next, the two round-shaping dies 49 in the upper die 47 are moved downward to thereby compress upper left and upper right ridge portions of the unfinished wood BS2, whereby unfinished wood BS3 is obtained (see FIG. 6C). Ridge portions R1 extending in the longitudinal direction are formed at upper left and upper right portions of the unfinished wood BS3.

As shown in FIG. 6D, in the removal process, a front upper portion C1 of the unfinished wood BS3 is removed by cutting or other processing to thereby form on the unfinished wood BS3 a front surface 34*c* which is a slant surface, whereby the compressed wood part 34 is obtained.

Although the illustration of how the corner portions R4 and ridge portions R5, R6 of the compressed wood part 34 are compression-molded is omitted, these portions can be formed by compression by a die structure similar to that shown in FIGS. 6A to 6C, as in the case of compression molding of the ridge portions R1.

With the compression molding, the compressed density automatically increases at the round-shaped 35 portions such as the corner portions R4 and the ridge portions R1, R5, R6 of the compressed wood part 34 (see FIGS. 3C, 3D). Usually, the color tone of compressed wood is dark at a high density portion. Therefore, the color tone of the compressed wood part 34 is automatically made darker at the corner portions R4 and the ridge portions R4, R5, R6, etc., thereof which are high in compressed density, than at other planar portions thereof. Thus, the contour of the black key can clearly be visible.

Since the compression rate is higher in the vertical direction than in the width and longitudinal directions, intervals in the woodgrain pattern automatically becomes broader on the upper surface 34*a* than on the front surface 34*c*, the left side surface 34*e*, and the right side surface 34*f* (see FIGS. 2B, 2C, and 2D).

As shown in FIG. 4A, the upper-face equivalent portion BSa and the lower-surface equivalent portion BSb of the unprocessed wood BS0 extend parallel to each other. On the other hand, the upper die 42 is formed such that the height of the lower surface 42*a* decreases toward rearward (to the right in the right drawing in FIG. 4A) so as to correspond to the upper surface 34*a* of the compressed wood part 34. Thus, in the compressed wood part 34 obtained by compression molding, the compressed density in the vertical direction automatically increases toward rearward, as described above.

As shown in FIG. 5A, the left and right side surfaces of the unfinished wood BS1 extend parallel to each other. On the other hand, the distance between the end surface 45La of the left die 45L and the end surface 45Ra of the right die 45R decreases toward upward in conformity with the trapezoidal shape of the compressed wood part 34 as seen from front. Thus, as described above, in the compressed wood part 34 obtained by compression molding, the compressed density in the width direction automatically decreases toward downward.

As far as the contour formation is concerned, the order of execution of the vertical compression process and the transverse compression process may be reversed. In a case where it is unnecessary to seek to attain advantages by the compressed density control, one or ones of the vertical compression process, the transverse compression process, and the round-shape formation process may be eliminated, and the contour formation may alternatively be performed by a removal process as shown in FIGS. 7A, 7B, and 7C.

Figure 7A:
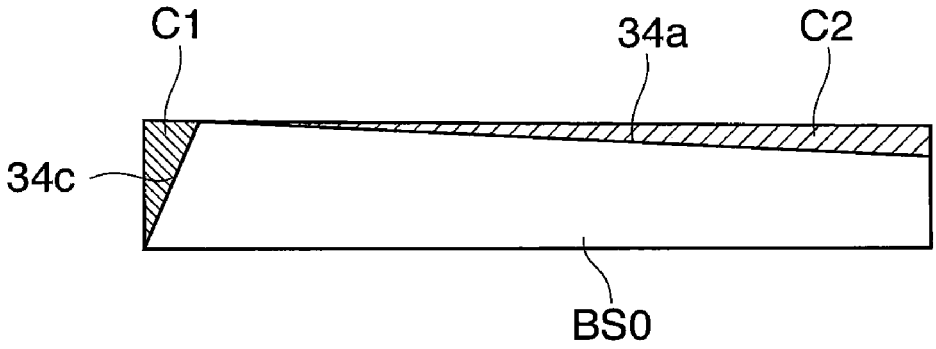
FIGS. 7A, 7B, and 7C are schematic views each showing the removal process for a case where the vertical compression process, the transverse compression process, or the round-shape formation process is eliminated.
Figure 7B:
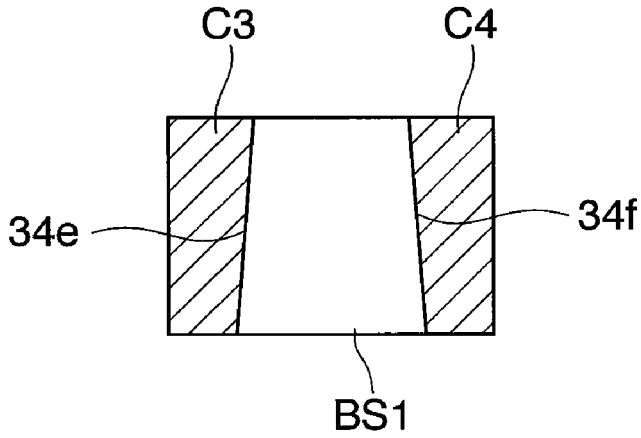
Figure 7C:
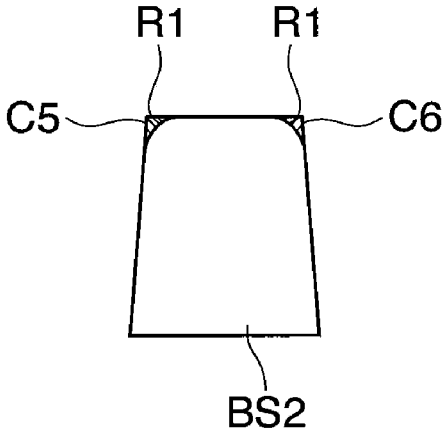

FIGS. 7A, 7B, and 7C each schematically show a removal process performed in a case where the vertical compression process, the transverse compression process, or the round-shape formation process is eliminated.

In the case of eliminating the vertical compression process, the portion C1 (see FIG. 6D) is removed, and an upper portion C2 of the unprocessed wood BS0 is also removed by cutting or other processing as shown in FIG. 7A to form a surface that constitutes the upper surface 34*a* of the black key 30. In the case of removing the transverse compression process, left and right side portions C3, C4 of the unfinished wood BS1 are removed as shown in FIG. 7B to form surfaces that constitute the left and right side surfaces 34*e*, 34*f* of the black key 30. In the case of eliminating the round-shape formation process, longitudinal ridges on upper left and right portions of the unfinished wood BS2 are, by way of example, removed as shown in FIG. 7C to form portions that constitute the ridge portions R1 of the black key (see FIG. 3D).

A compression molding process, not shown, for the compressed wood part 24 of the white key can be performed in the same manner as that for the compressed wood part 34 of the black key 30. Unprocessed wood BS used for the compressed wood part 24 is a parallelepiped. Preferably, the unprocessed wood BS is fabricated such that an average compressed density of the compressed wood part 24 of the white key is lower than that of the compressed wood part 34 of the black key 30. Since the color tone becomes darker with increase in compressed density, the color tone of the compressed wood part 34 of the black key 30 is automatically made darker by the compression molding than the color tone of the compressed wood part 24 of the white key 20, whereby an easy visual distinction between the white key and the black key 30 can be made, without the need of subsequently applying coloring thereto.

As far as is concerned the purpose of providing a color tone difference at least between the key-depression surface of the white key and that of the black key 30, the unprocessed wood BS may be processed such that at least the vertical compressed density of the compressed wood part 24 of the white key is made lower than that of the compressed wood part 34 of the black key 30.

The compressed wood parts 24, 34 obtained by compression molding and not applied with a surface treatment such as color painting are secured to the resin parts 21, 31, whereby the white key and the black key 30 are completed. The compressed wood parts 24, 34 are made high by compression in surface hardness and in accuracy of surface roughness, and are not required to be polished. The compressed wood parts 24, 34 are therefore adequate in terms of strength and abrasion resistance, and can withstand use at keyboard performance. The compression molding is also advantageous in that no chips are produced.

The compressed wood part 24 of the white key 20 30 applied with no surface treatment is not white in color, and the compressed wood part 34 of the black key 30 applied with no surface treatment is not black in color. In this embodiment, the terms "white key" and "black key" do not represent keys which are white in color and black in color, but indicate keys which are similar in outer shape to white and black keys of an ordinary keyboard apparatus.

Burrs can be produced on the compressed wood parts 24, 34 which are formed by use of dies. As will be explained below, it is preferable that the directions in which the burrs project from the compressed wood parts 24, 34 be regulated.

Figure 8A:
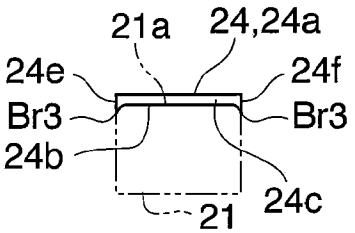
FIGS. 8A and 8B are front and side views showing the compressed wood part of the white key according to the embodiment.
Figure 8B:
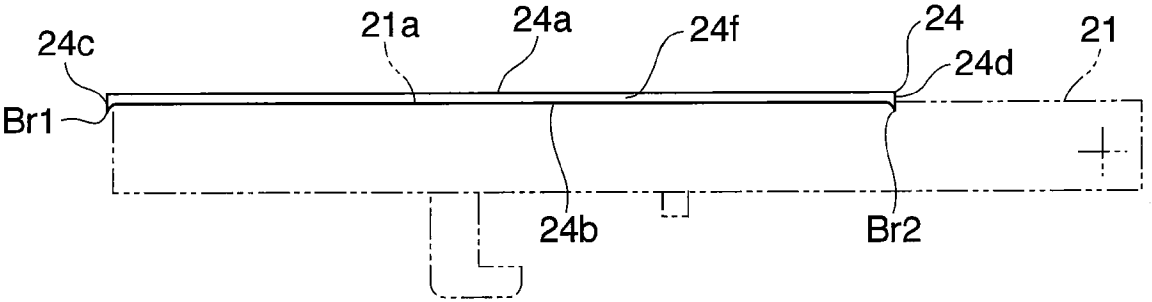
Figure 8C:
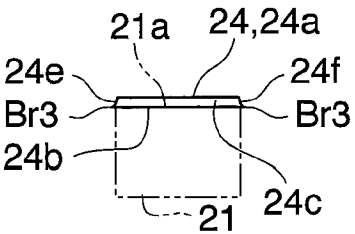
FIGS. 8C and 8D are front and side views showing a compressed wood part of a white key according to a comparative example.
Figure 8D:
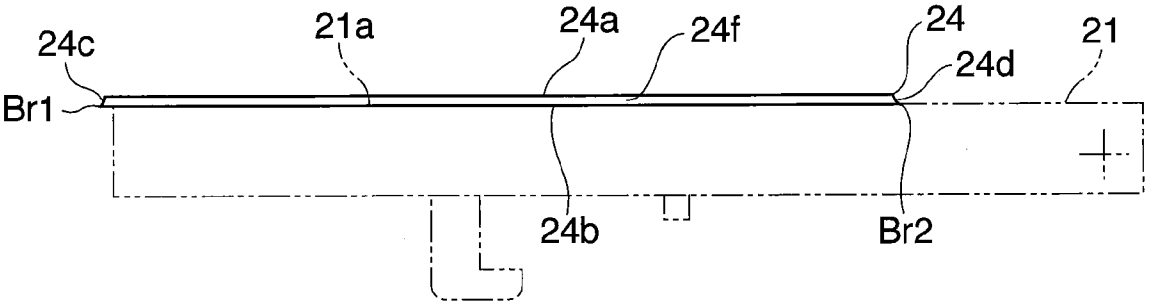
Figure 8E:
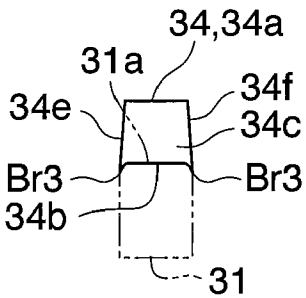
FIGS. 8E and 8F are front and side views showing the compressed wood part of the black key according to the embodiment.
Figure 8F:
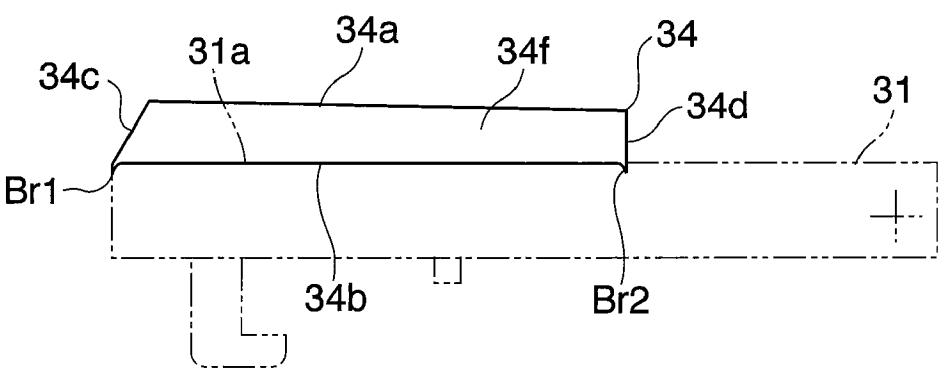
Figure 8G:
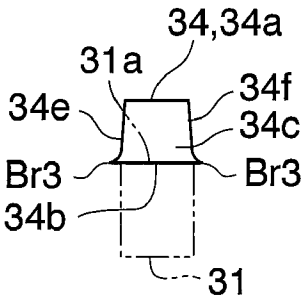
FIGS. 8G and 8H are front and side views showing a compressed wood part of a black key according to a comparative example.
Figure 8H:
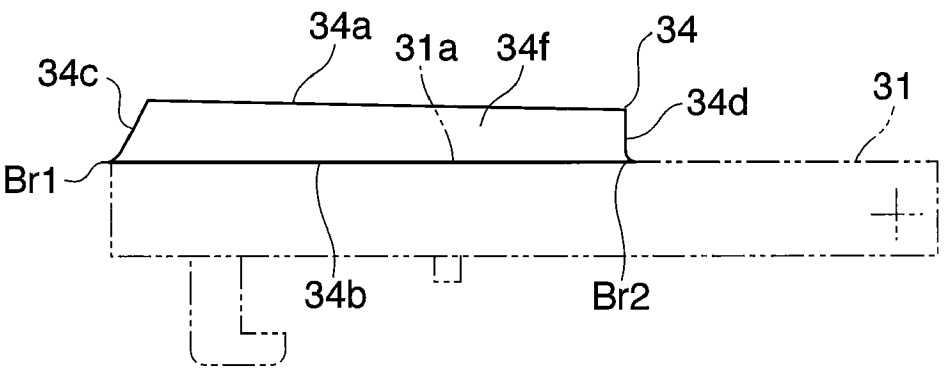

FIGS. 8A and 8B show in front and side views the compressed wood part 24 of the white key of this embodiment, and FIGS. 8E and 8F show in front and side views the compressed wood part 34 of the black key 30 of this embodiment. FIGS. 8C, 8D, 8G, and 8H show undesirable comparative examples of compressed wood parts 24, 34 of while and black keys 20, 30.

As for the compressed wood part 34 of the black key 30, it is preferable that burrs be regulated to vertically downwardly project only from the circumference of the lower surface 34*b* of the compressed wood part 34. In that case, as shown in FIGS. 8E and 8F, burrs Br1, Br2, and Br3 project vertically downwardly from the front surface 34*c*, the rear surface 34*d*, and the left and right side surfaces 34*e*, 34*f* of the compressed wood part 34, and do not project therefrom in any directions other than the vertical downward direction. Thus, also in the completed black key 20, the burrs Br do not project from the front, rear, left side, and right side surfaces of the black key in any directions other than the vertical downward direction. Therefore, post-processing to remove the burrs Br is unnecessary, and the safety and the satisfactory external appearance can be ensured.

On the other hand, in the undesirable comparative examples (FIGS. 8G and 8H), burrs Br1, Br2, Br3 project from the front surface 34*c*, the rear surface 34*d*, and the left and right side surfaces 34*e*, 34*f* of the compressed wood part 34 in directions other than the vertical downward direction (i.e., oblique downward, forward, and rearward directions), and therefore, post-processing to remove the burrs is necessary.

The above also applies to the compressed wood part 24 of the white key 20. In the undesirable comparative examples shown in FIGS. 8C and 8D, burrs Br1, Br2 and Br3 project from the front surface 24*c*, the rear surface 24*d*, and the left and right side surfaces 24*e*, 24*f* of the compressed wood part 24 in directions other than the vertical downward direction. On the other hand, in the embodiment shown in FIGS. 8A and 8B, burrs Br do not project from the front, rear, left and right side surfaces of the compressed wood part 24 in directions other than the vertical downward direction.

The directions of burrs Br can be regulated by way of example as described below: The direction of the burr Br3 on the black key 30 can be regulated by using, in the transverse compression process (FIG. 5), the lower die 43 having a width thereof slightly smaller than a width of a bottom surface of the unfinished wood BS2 (FIG. 5C) and the left and right dies 45L, 45R having lower surfaces thereof positioned below an upper surface of the lower die 43.

The above also applies to the control of directions of burrs Br1, Br2. Specifically, prior to or subsequent to the transverse compression process, there is provided a process for compressing the unfinished wood BS in the longitudinal direction. In that process, there are used a lower die positioned below the unfinished wood BS and having a longitudinal length thereof slightly smaller than that of the unfinished wood BS, and dies positioned forward and rearward of the lower die and having lower surfaces thereof positioned lower than an upper surface of the lower die, whereby the directions of the burrs Br1, Br2 can be regulated. Similarly, the directions of burrs produced on the white key can also be regulated.

The directions of the burrs Br1, Br2, Br3 can also be regulated by using a modified arrangement of that shown in FIG. 4. In the modified arrangement, the upper die 42 is made stationary, the upper surface of the unprocessed wood BS0 is secured to the upper die 42, and the lower die 41 is moved to compress the unprocessed wood BS0.

According to the present embodiment, since key-depression-surface-including portions of the white and black keys 20, 30 are formed by the compressed wood parts 24, 34, it is possible to provide key-depression surfaces with a woody characteristic and durability, without the need of applying a surface treatment to the key-depression surfaces.

In the black key 30, especially, in the compressed wood part 34 thereof, the compressed density in the vertical direction is made higher toward rearward, and the compressed density in the width direction is made lower toward downward by compression molding. Thus, even by using the unprocessed wood BS0 which is simple in shape such as a rectangular parallelepiped shape, the black key can easily be formed into a specific shape peculiar to the black key. Therefore, uncompressed wood can have a simple shape.

Furthermore, those positions of the unprocessed wood BS constituting the corner and ridge portions R1 to R6 (FIG. 3) of the white and black keys 20, 30 are formed into rounded shapes with a compressed density higher than that of other portions. Thus, wood having a simple shape and having squared corners can be used as the unprocessed wood BS. Also in this point, uncompressed wood can have a simple shape. In addition, the unfinished wood BS is compression molded at higher compressed density at its portions constituting the corner and ridge portions of the key. Thus, the contours of the white and black keys 20, 30 are made clearly visible, even if special coloring or other treatment is not applied thereto.

As described above, the vertical compression process, the transverse compression process and/or the round-shape formation process can be eliminated. It is apparent that the shape of the unprocessed or unfinished wood BS before execution of each process is simpler than that of the compressed wood part 24 or 34, which is a finished product.

In the compressed wood parts 24, 34 obtained by compression molding, burrs Br produced thereon do not project from their front, rear, left, and right side surfaces in directions other than the vertical downward direction (see FIG. 8). Thus, a burr removal process is unnecessary, and the safety at musical performance and a satisfactory appearance can be ensured.

In addition, pieces of unprocessed wood BS are prepared such that their woodgrain directions extend along the longitudinal directions of the white and black keys 20, 30. Thus, the unprocessed wood BS is compressed in a direction perpendicular to the fiber direction, whereby the compression molding becomes easy to carry out, and the woodgrain patterns 25, 35 of the compressed wood parts 24, 34 after compression become natural, making it possible to improve the external appearance.

The compressed density of the compressed wood parts 24, 34 is lower in the width direction than in the vertical direction. Therefore, the intervals in the woodgrain patterns 25, 35 on the key-depression surface liable to catch the eye are not made too narrow, whereby a natural woody texture can be provided, and the external appearance can be improved.

The average compressed density in the compressed wood part 24 of the white key is lower than that of the compressed wood part 34 of the black key 30, resulting in difference in color tone and woodgrain interval between the compressed wood parts 24, 34, which makes it easy to visually distinguish the white and black keys 20, 30 from one another, without the need of applying surface painting to the compressed wood parts 24, 34 in white and black in color. From the viewpoint of enabling the white and black keys 20, 30 to be visually distinguished from one another based on a color tone difference between their key-depression surfaces, it is enough to make the average compressed density different at least in the vertical direction between the compressed wood parts 24, 34.

As described above, the compressed density in the vertical direction of the compressed wood part 34 of the black key 30 is higher toward rearward, and the compressed density in the width direction of the compressed wood part 34 is lower toward downward and is lower than that in the vertical direction. Such a compressed density distribution contributes, as described below, to reduce problems caused by a dimensional change after shape fixation due to the presence of anisotropy in compression rate.

In general, wood compression molding includes three steps, i.e., a material softening process, a compression molding process, and a shape fixation process. In the case of compression molding into a simple hexahedron shape, there is produced a small variation (anisotropy) in compression rate. On the other hand, in the case of forming a complicated three-dimensional shape, e.g., the compressed wood part 34 of the black key 30, the compression rate inevitably varies due to the complexity of shape. The resultant anisotropy produces disadvantages such as a dimensional change after the shape fixation subsequent to the compression molding. The dimensional change is generally more noticeable at portions in which the compression rate is high.

Generally, the black key requires less dimensional accuracy in the vertical direction than in the 35 width direction in which a proper gap must be provided between adjacent keys. In other words, an allowable range of dimensional change is broader in the vertical direction than in the width direction. The compressed wood part 34 of this embodiment in which the compressed density is lower in the width direction than in the vertical direction is suitable in use under the above described circumstance.

During the performance, the player less frequently touches a rear portion of the black key 30 than a front portion thereof, and therefore the black key 30 requires less vertical dimensional accuracy in the rear portion than in the front portion. The compressed wood part 34 of this embodiment in which the vertical compressed density is made higher toward rearward is suitable in use under that circumstance.

When taken into a consideration the relation between the black key 30 and the adjacent white or black key or 30, the allowable range of dimensional change is narrow for the black key 30 at a portion close to the key-depression surface of the white key (i.e., a lower portion of the compressed wood part 34) at which the distance from the adjacent key is small. On the other hand, the distance between the black key 30 and the adjacent key becomes larger at an upper portion of the black key 30 of a trapezoidal shape. Thus, even if there occurs a dimensional change, no substantial problem is caused, which indicates that the allowable range of dimensional change is wider toward upward. The compressed wood part 34 of this embodiment in which the compressed density in the width direction is made lower toward downward is therefore suitable in use under such circumstance.

Ranges in the white and black keys 20, 30 to which the compressed wood parts 24, 34 are applied are not limited to those of the above described example, but may be changed as described in the following modifications.

Figure 9A:
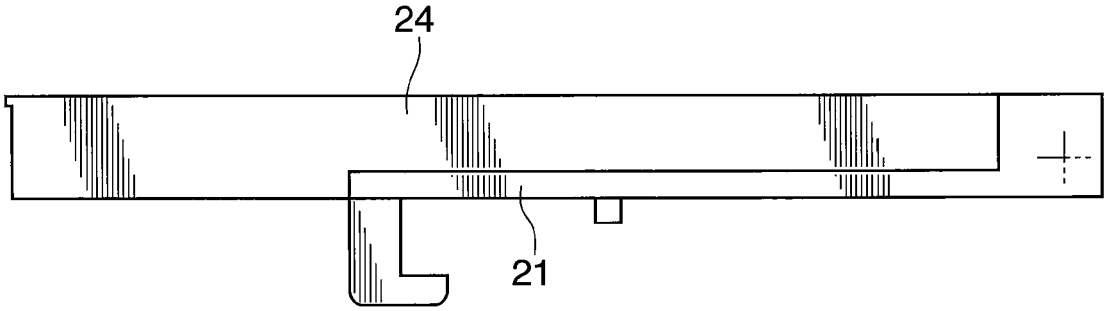
FIG. 9A is a side view showing a white key according to a modification where an application range of a compressed wood part is made different from that of the embodiment.
Figure 9B:
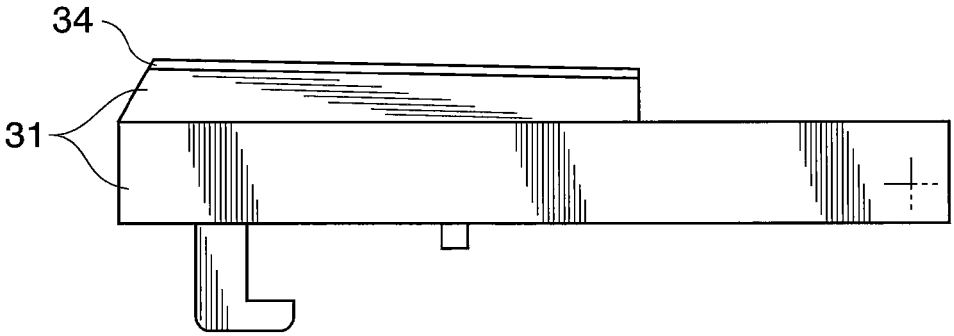
FIGS. 9B and 9C are side views showing a black key according to a modification where an application range of a compressed wood part is made different from that of the embodiment.
Figure 9C:
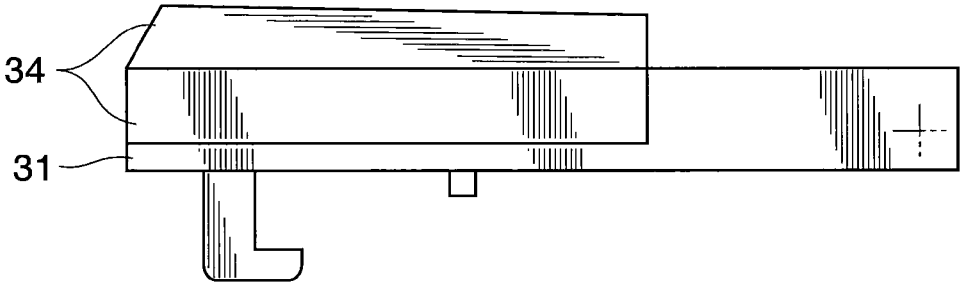

FIG. 9A shows in side view a white key according to a modification in which the range to which the compressed wood part 24 is applied is made different from that of the embodiment, and FIGS. 9B and 9C show in side view a black key 30 according to a modification in which the range to which the compressed wood part 34 is applied is made different from that of the embodiment.

As shown in FIG. 9A, in the white key according to the modification, the compressed wood part 24 is not only applied to a surface layer of the white key 20, but also applied to side portions of the white key so as to cover up to lower side portions of the white key 20. As a result, a wood characteristic can be attained over a wide area on the side portions of the white key 20. Especially, by providing the compressed wood part 24 at the side portions of the white key so as to extend up to a position enough to prevent the resin part 21 from becoming visible when one of the adjacent white keys is depressed, the external appearance at the performance can be improved.

As for the black key 20, the compressed wood part 34 may be applied only to a surface layer of the black key 30 (see FIG. 9B). Alternatively, as with the case shown in FIG. 9A, the compressed wood part 34 may be provided so as to cover up to a lower side half of the black key 30 (see FIG. 9C).

As described above, the compressed wood parts 24, 34 can be applied to key top portions including upper surfaces 24*a*, 34*a* which constitute key-depression surfaces. The compressed wood parts 24, 34 may be applied to at least those portions which are disposed above the upper surface 24*a* of the white key which is in a non-depression-key state. Alternatively, the compressed wood parts 24, 34 may be applied to the entirety of the white and black keys.

In a case where the finishing dimensional accuracy of the compressed wood parts 24, 34 is difficult to increase from the viewpoint of costs, etc., the compressed wood parts 24 may not be applied to the white keys of a keyboard apparatus, but the compressed wood parts 34 may be applied to the black keys 30. Since adjacent black keys 30 are disposed to be more apart from each other than in the case of adjacent white keys 20, unevenness in position of upper surfaces 34*a* of the black keys 30 is not noticeable. Thus, some variation in vertical dimension can be allowed in the black keys 30, and therefore the compressed wood parts 34 are easy to apply to the black keys 30.

The structure of compressed wood part 34 in which the compressed density in the vertical direction is higher toward rearward and the compressed density in the width direction is lower toward downward may be applied to at least that portion of the compressed wood part 34 which is disposed above the upper surface 24*a* of the white key 20, which is in a non-depression state.

What is claimed is:

1. A key for a keyboard instrument, comprising: a part including an upper surface that constitutes at least a key-depression surface of the key, wherein said part is made of compressed wood, and a compressed density of the compressed wood is different by portion, wherein the key is used for as a black key of the keyboard instrument, said part made of compressed wood includes at least another part adapted to be positioned above upper surfaces of white keys of the keyboard instrument which are in a non-key depression state, and a compressed density in a width direction in said another part of the key is lower toward downward from the upper surface of said part of the key.

2. The key according to claim 1, wherein burrs produced on said part at compression molding protrude only downward from front, rear, left, and right surfaces of said part of the key.

3. The key according to claim 1, wherein a woodgrain direction of said part made of compressed wood extends in a longitudinal direction of the key.

4. The key according to claim 1, wherein the compressed density of said part made of compressed wood is higher in a vertical direction than in a width direction.

5. A keyboard apparatus including a plurality of keys, wherein at least part of the plurality of keys are each formed by the key as set forth in claim 1.

6. The keyboard apparatus according to claim 5, wherein the plurality of keys include a plurality of white keys and a plurality of black keys, each of the white keys and the black keys has the part including the upper surface of the key and made of compressed wood, and the compressed density in the vertical direction in the parts of the black keys is higher than the compressed density in the vertical direction in the parts of the white keys.

7. The keyboard apparatus according to claim 5, wherein a color tone of at least upper surfaces of the parts of the black keys is made darker than a color tone of the parts of the white keys by making the compressed density in the vertical direction in the parts of the black keys higher than the compressed density in the vertical direction in the parts of the white keys.

8. A key for a keyboard instrument, comprising: a part including an upper surface that constitutes at least a key-depression surface of the key, wherein said part is made of compressed wood, and a compressed density of the compressed wood is different by portion, wherein: said part made of compressed wood includes portions that constitute corner portions and ridge portions of the key and are higher in compressed density than in other portions of said part made of compressed wood.

9. The key according to claim 8, wherein burrs produced on said part made of compressed wood at compression molding protrude only downward from front, rear, left, and right surfaces of said part of the key.

10. The key according to claim 8, wherein a woodgrain direction of said part made of compressed wood extends in a longitudinal direction of the key.

11. The key according to claim 8, wherein the compressed density of said part made of compressed wood is higher in a vertical direction than in a width direction.

12. The key according to claim 8, wherein the corner portions and the ridge portions of the key have a color tone darker than that of the other portions of the key by having a compressed density higher than that of other portions of the key.

13. A keyboard apparatus including a plurality of keys, wherein at least part of the plurality of keys are each formed by the key as set forth in claim 8.

14. The keyboard apparatus according to claim 13, wherein the plurality of keys include a plurality of white keys and a plurality of black keys, each of the white keys and the black keys has the part including the upper surface of the key and made of compressed wood, and the compressed density in the vertical direction in the parts made of compressed wood of the black keys is higher than the compressed density in the vertical direction in the parts made of compressed wood of the white keys.

15. The keyboard apparatus according to claim 13, wherein a color tone of at least upper surfaces of the parts made of wood of the black keys is made darker than a color tone of the parts made of wood of the white keys by making the compressed density in the vertical direction in the parts made of compressed wood of the black keys higher than the compressed density in the vertical direction in the parts made of compressed wood of the white keys.

* * * * *